US012560031B1

(12) United States Patent
Albeshri et al.

(10) Patent No.: US 12,560,031 B1
(45) Date of Patent: Feb. 24, 2026

(54) WIRELINE TOOLS WITH TOOL BRAKE ASSEMBLIES

(71) Applicant: Saudi Arabian Oil Company, Dhahran (SA)

(72) Inventors: Raissan F. Albeshri, Safwa (SA); Saad I. Jumaiaah, Qatif (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/009,114

(22) Filed: Jan. 3, 2025

(51) Int. Cl.
*E21B 17/02* (2006.01)
*E21B 17/10* (2006.01)

(52) U.S. Cl.
CPC ..... *E21B 17/023* (2013.01); *E21B 17/1078* (2013.01)

(58) Field of Classification Search
CPC ... E21B 17/023; E21B 17/026; E21B 17/1078
See application file for complete search history.

(56) References Cited

U.S. PATENT DOCUMENTS 2,127,900 A * 8/1938 York ..... E21B 23/01 166/211
3,311,171 A * 3/1967 Castro ..... E21B 33/129 166/182
3,382,929 A * 5/1968 Plunk ..... E21B 23/01 166/243
9,217,305 B2 12/2015 Coles et al.
2004/0011533 A1* 1/2004 Lawrence ..... E21B 23/0419 166/212
2015/0285017 A1* 10/2015 Coles ..... G01V 11/005 166/382

OTHER PUBLICATIONS

"AR Tubing Stop", https://www.bracetool.com/catalog/wireline-products/ar-tubing-stop, 2023.
Western Pressure Controls Ltd, "Tubing Stop", https://westernpressure.com/tubing-stop/, 2025.

* cited by examiner

*Primary Examiner* — David Carroll
(74) *Attorney, Agent, or Firm* — DINSMORE & SHOHL LLP

(57) ABSTRACT

A wireline tool assembly for operating in a wellbore extending into a subterranean formation includes a tool brake assembly, and the tool brake assembly include having a tool body comprising a cylindrical wall section, an activation ring having a specific weight distribution and circumscribing the cylindrical wall section, a stop mechanism moveable between a stowed position and a deployed position, and an actuator. The activation ring is configured to remain in a fixed position during normal operation of the wireline tool assembly and to move axially relative to the tool body during freefall of the wireline tool assembly. During freefall of the wireline tool assembly, the activation ring moves axially relative to the tool body to cause the actuator to move the stop mechanism into the deployed position into contact with the wellbore wall to stop the wireline tool assembly.

20 Claims, 8 Drawing Sheets

WIRELINE TOOLS WITH TOOL BRAKE ASSEMBLIES

TECHNICAL FIELD

The present specification generally relates to natural resource well drilling, in particular, to wireline tool assemblies for use in a wellbore.

BACKGROUND

Production of hydrocarbons from a subterranean formation generally includes drilling at least one wellbore into the subterranean formation. The wellbore forms a pathway capable of permitting both fluids and apparatus to traverse between the surface and the subterranean formations. Besides defining the void volume of the wellbore, the wellbore wall also acts as an interface through which fluid can flow between the subterranean formation and the interior of the wellbore. Hydrocarbon producing wellbores extend subsurface and intersect various subterranean formations where hydrocarbons are trapped. Wellbores may also include injection wellbores, exploration wellbores, or other any other type of wellbores.

At several points during wellbore drilling, wellbore completion, production, injection, or wellbore closure, wireline tools, such as but not limited to data loggers, perforation tools, injection tools, or other wireline tools are lowered downhole to complete one or more operations within the wellbore. These wireline tools are lowered into the wellbore and retrieved from the wellbore using a wireline or slickline.

SUMMARY

During use of a wireline tool in a wellbore, the wireline tool, on occasion, may become separated from the wireline, such as by failure of a connection or failure of the wireline itself. When this happens, the wireline tool falls downhole to the next obstruction in the wellbore or all the way to the bottom of the wellbore. Retrieving the wireline tool from its final downhole position can involve an expensive and time consuming fishing enterprise, since the final resting place of the wireline tool is unknown and the wireline tool may not be oriented in a way that allows for easy connection to the wireline tool during fishing. If the wireline tool cannot be retrieved, then the wireline tool is lost and is either abandoned at the bottom of the wellbore or drilled through to continue extension of the wellbore.

Accordingly, there is an ongoing need for apparatuses and methods for stopping wireline tools in a wellbore in the event of separation of the wireline tools from the wireline or slickline. The present disclosure is directed to a tool brake assembly that can be incorporated into a wireline tool assembly. The tool brake assemblies of the present disclosure can easily and quickly stop the wireline tool assembly in the event of detachment of the wireline tool assembly from the wireline or slickline. The tool brake assembly includes a tool body, an activation ring circumscribing the tool body, a stop mechanism operatively coupled to the detection ring, and an actuator configured to cause the stop mechanism to move to the deployed position when the activation ring rises up the tool body. In embodiments, the tool brake assembly may further include a biasing mechanism coupled to the stop mechanism and configured to bias the stop mechanism into a stowed position.

When the wireline tool becomes separated from the wireline and freefalls within the wellbore, the freefall condition causes the activation ring to move axially relative to the tool body. Movement of the activation ring causes the stop mechanism to move to a deployed position in which the stop mechanism engages with the wellbore wall. The stop mechanism is moved to the deployed position though axial movement of the activation ring itself or through activation of the actuator caused by axial movement of the activation ring. Engagement of the stop mechanism with the wellbore wall stops the wireline tool in the wellbore, which may enable easier recovery of the wireline tool from the wellbore.

According to one or more aspects of the present disclosure, a wireline tool assembly for operating in a wellbore extending into a subterranean formation includes a tool brake assembly. The tool brake assembly includes a tool body comprising a cylindrical wall section having an outer surface and an activation ring having a specific weight distribution, wherein the activation ring circumscribes the outer surface of the cylindrical wall section of the tool body and the activation ring is movable in an axial direction relative to the tool body. The tool brake assembly further includes a stop mechanism coupled to the activation ring or to the tool body and configured to move between a stowed position and a deployed position. The tool brake assembly may further include an actuator operatively coupled to the tool body and configured to cause the stop mechanism to move from the stowed position to the deployed position when the activation ring moves axially relative to the tool body. The specific weight distribution of the activation ring is configured to cause the activation ring to remain in a fixed position during normal operation of the wireline tool assembly and to move axially relative to the tool body during freefall of the wireline tool assembly. In the deployed position, the stop mechanism extends radially outward from the tool body and into contact with a wellbore wall of the subterranean wellbore to impede translation of the wireline tool assembly axially downward through the wellbore.

Additional features and advantages of the technology described in this disclosure will be set forth in the detailed description which follows, and in part will be readily apparent to those skilled in the art from the description or recognized by practicing the technology as described in this disclosure, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Figure 1:
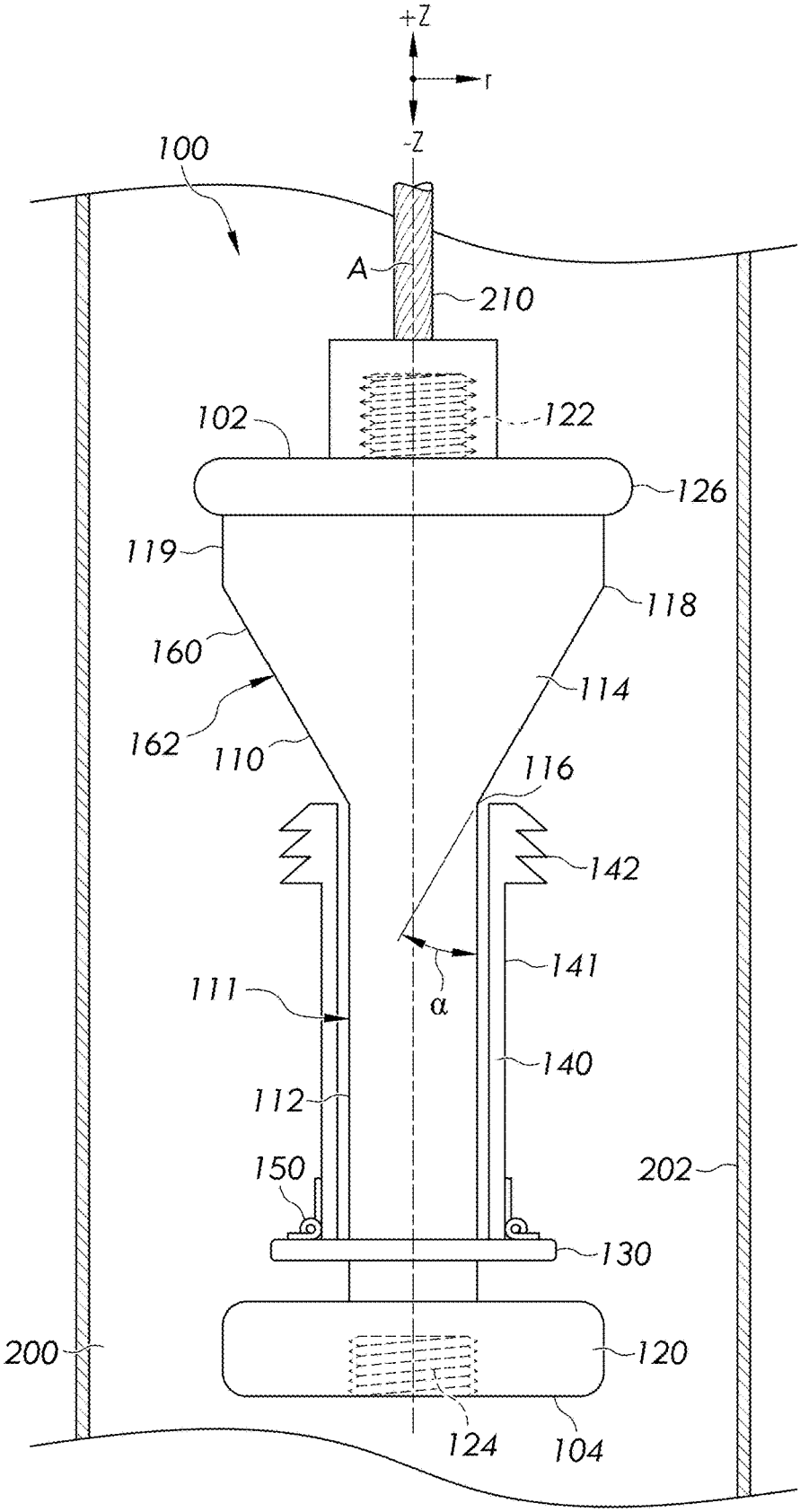
FIG. 1 schematically depicts a side view of a tool brake assembly, according to embodiments shown and described in this disclosure.

Reference will now be made in greater detail to various embodiments, some embodiments of which are illustrated in the accompanying drawings. Whenever possible, the same reference numerals will be used throughout the drawings to refer to the same or similar parts. The drawings are not to-scale, and certain features may be exaggerated in the drawings for purposes of clearly illustrating the subject matter of the present disclosure.

DETAILED DESCRIPTION

The present disclosure is directed to a tool brake assembly for wireline tools used in wellbores for extracting resources from subterranean formations. Referring now to FIG. 1, one embodiment of a tool brake assembly 100 of the present disclosure is schematically depicted. The tool brake assembly 100 includes a tool body 110, an activation ring 130, a stop mechanism 140, and an actuator 160. The tool body 110 may comprise a cylindrical wall section 112 having an outer surface 111. The activation ring 130 may have a specific weight distribution and may circumscribe the outer surface 111 of the cylindrical wall section 112 of the tool body 110. The activation ring 130 may be movable in an axial direction relative to the tool body 110. The stop mechanism 140 may be coupled to the activation ring 130 or to the tool body 110 and may be configured to move between a stowed position and a deployed position. The actuator 160 may be operatively coupled to the tool body 110 and may be configured to cause the stop mechanism 140 to move from the stowed position to the deployed position when the activation ring 130 moves axially relative to the tool body 110.

The specific weight distribution of the activation ring 130 may be configured to cause the activation ring 130 to remain in a fixed position during normal operation of the wireline tool and to move axially relative to the tool body 110 during freefall of the tool brake assembly 100. In the deployed position, the stop mechanism 140 may extend radially outward from the tool body 110 and into contact with a wellbore wall 202 of the wellbore 200 to impede translation of the tool brake assembly 100 axially downward through the wellbore 200. The tool brake assemblies 100 of the present disclosure can be incorporated into wireline tool assemblies 212, which can be attached to a wireline 210 and lowered into the wellbore 200 to accomplish one or more operations within the wellbore 200. The tool brake assemblies 100 of the present disclosure can easily and quickly stop the wireline tool assembly 212 within the wellbore 200 in the event of detachment of the wireline tool assembly 212 from the wireline 210, among other features.

As used throughout the present disclosure, the term "hydrocarbon-bearing formation" refers to a subterranean geologic region containing hydrocarbons, such as crude oil, hydrocarbon gases, or both, which may be extracted from the subterranean geologic region. The terms "subterranean formation" or just "formation" refers to a subterranean geologic region that contains hydrocarbons or a subterranean geologic region proximate to a hydrocarbon-bearing formation, such as a subterranean geologic region to be treated for purposes of enhanced oil recovery or reduction of water production.

As used in the present disclosure, the term "uphole" refers to an axial direction in a wellbore that is towards the surface. For instance, a first component that is uphole relative to a second component is positioned in the wellbore closer to the surface relative to the second component. The uphole direction corresponds to the +Z direction in the coordinate axis in the figures.

As used in the present disclosure, the term "downhole" refers to an axial direction in a wellbore that extends further into the formation and away from the surface. For instance, a first component that is downhole relative to a second component is positioned farther away from the surface of the wellbore relative to the second component. The downhole direction corresponds to the −Z direction of the coordinate axis in the figures.

As used in the present disclosure, the term "axial" refers to a direction parallel with a center axis of the wellbore, and is generally designated as the +/−Z direction of the coordinate axis in the figures.

As used in the present disclosure, the term "fluid" includes liquids, gases, or both and may include solids in combination with the liquids, gases, or both, such as but not limited to suspended solids in the wellbore fluids, entrained particles in gas produced from the wellbore, drilling fluids comprising weighting agents, or other mixed phase suspensions, slurries and other fluids commonly used in wellbore drilling and production.

As used in the present disclosure, components coupled "directly" to one another refers to a first component being coupled to and in contact with a second component without a third component intervening between the first and second components.

As used in the present disclosure, the term "freefall" refers to uncontrolled downhole translation of an object through a fluid in a wellbore under the force of gravity without restriction through a connection to the surface, such as a connection to the surface through a wireline, slickline, drill string, or other mechanical connection to the surface of the wellbore. "Freefall" refers to uncontrolled downhole translation of an object under the force of gravity in any type of fluid, such as but not limited to air, drilling fluids, spacer fluids, water, or any other fluids present in the wellbore.

As used in the present disclosure, the term "wireline tool" refers to tooling inserted into a wellbore using either a wireline or a slickline. For efficiency purposes, the term "wireline tool" refers to tools attached to a wireline and also to tools attached to a slickline or other line or cable capable of being run downhole. The term "wireline tool" is not intended to cover downhole assemblies attached to a drill string.

As used in the present disclosure, the term "wireline tool assembly" refers to an assembly of parts that includes at least one wireline tool and is attached to a wireline, slickline, or other line capable of being run downhole.

Figure 2:
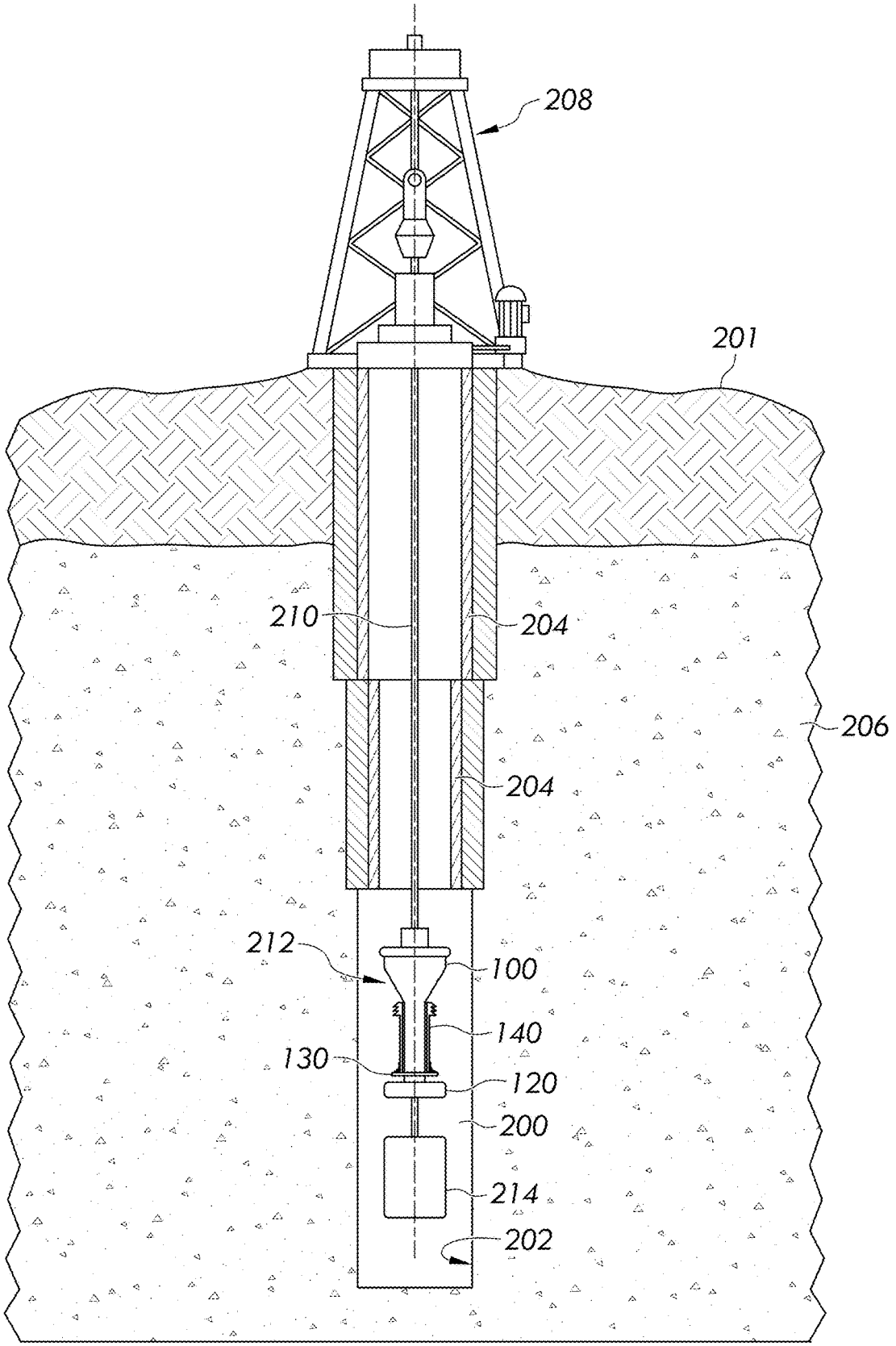
FIG. 2 schematically depicts a wireline tool assembly comprising the tool brake assembly of FIG. 1 attached to a wireline and disposed in a subterranean wellbore, according to embodiments shown and described in this disclosure.

Referring now to FIG. 2, a wellbore 200 extending from the surface 201 into a subterranean formation 206 is schematically depicted. The wellbore 200 forms a pathway capable of permitting both fluids and apparatus to traverse between the surface 201 and the subterranean formation 206, such as a hydrocarbon-bearing subterranean formation. The wellbore 200 may include at least a portion of a fluid conduit that links the interior of the wellbore 200 to the surface 201. The fluid conduit connecting the interior of the wellbore 200 to the surface 201 can be capable of permitting regulated fluid flow from the interior of the wellbore 200 to the surface 201 and can permit access between equipment on the surface 201 and the interior of the wellbore 200. Equipment connected at the surface 201 to the fluid conduit may include but is not limited to pipelines, tanks, pumps, compressors, flares, analytical equipment, or other types of equipment. The fluid conduit may be large enough to permit introduction and removal of mechanical devices, including but not limited to tools, drill strings, sensors, instruments, or combinations of these into and out of the interior of the wellbore 200. The wellbore 200 may include a surface installation 208 for facilitating insertion and removal of equipment into the wellbore 200 from the surface 201.

Wireline well intervention is one of the most common methods of extracting oil and monitoring well conditions downhole in the wellbore 200. Wireline tool assemblies 212 comprising one or more wireline tools 214 can be inserted into the wellbore 200 on a wireline 210, slickline, or other type of line during drilling, production, or closure operations of the wellbore 200. The wireline tools 214 of the wireline tool assemblies 212 can be used to conduct activities like sampling, perforating the wellbore wall 202 or liner 204 installed in the wellbore 100, logging data about conditions of the wellbore 200 or the surrounding rock in the subterranean formation 206, or other actions.

However, some conditions within the wellbore 200 may be mostly unknown, and these unknown conditions can sometimes lead to separation of wireline tool assemblies 212 from the wireline 210, such as failure of one or more connections coupling the wireline tool assembly 212 to the wireline 210 or failure of the wireline 210 itself. When the wireline tool assembly 212 separates from the wireline 210, the wireline tool assembly 212 experiences uncontrolled freefall axially downhole through the wellbore 200, which can result in excessive movement speed. Contact of the wireline tool assembly 212 with the wellbore wall 202, liner 204, or other downhole equipment at the increased movement speed can damage the wireline tools 214 in the wireline tool assembly 212. Additionally, freefall of the wireline tool assembly 212 axially downhole continues until the wireline tool assembly 212 encounters another piece of downhole equipment or the bottom of the wellbore 200.

Wireline tools 214 can be expensive. Therefore, efforts are often made to retrieve the wireline tool assembly 212 from the wellbore 200 through one or more manual "fishing" techniques. Fishing to retrieve the wireline tool assembly 212 from its final downhole resting place in the wellbore 200 can be time-consuming and expensive. During the fishing efforts to retrieve the wireline tool assembly 212, the wellbore 200 is down, meaning that drilling, completion, production, or other use of the wellbore 200 is halted until the wireline tool assembly 212 is retrieved. Drilling, completion, or production, delays and downtime for the wellbore 200 can be costly. In the event the wireline tool assembly 212 cannot be retrieved from the wellbore 200, the wireline tool assembly 212 must be abandoned or drilled through to continue extension of the wellbore 200, resulting in loss of the expensive wireline tools 214. Accordingly, an ongoing need exists for wireline tool assemblies capable of mitigating damage to the tools and wellbore downtime in the event of detachment of the wireline tool from the wireline.

These problems are solved by the subject matter of the present disclosure, which is directed to a tool brake assembly for a wireline tool assembly, where the tool brake assembly easily and quickly stops the wireline tool assembly in the event of detachment of the wireline tool assembly from the wireline. Referring again to FIG. 1, the tool brake assemblies 100 of the present disclosure include a tool body 110, an activation ring 130 circumscribing the tool body 110, a stop mechanism 140 operatively coupled to the activation ring 130, and an actuator 160 configured to move the stop mechanism 140 between a stowed position and a deployed position. The activation ring 130 may have a weight distribution that causes the activation ring 130 to remain at a fixed axial position relative to the tool body 110 during normal operation of the wireline tool assembly 212 and translate axially relative to the tool body 110 during freefall of the wireline tool assembly 212 in the wellbore 200. The tool brake assemblies 100 may further include a biasing mechanism 150 configured to bias the stop mechanism 140 into the stowed position.

Referring to FIGS. 1 and 2, during normal operation of the wireline tool assembly 212 comprising the tool brake assembly 100, the activation ring 130 may be in a fixed axial position relative to the tool body 110, and the biasing mechanism 150 may bias the stop mechanism 140 into the stowed position, which allows the wireline tool assembly 212 to be translated axially through the wellbore 200 using the wireline 210. In the event the wireline tool assembly 212 becomes separated from the wireline 210 or the wireline 210 breaks, freefall of the wireline tool assembly 212 through the wellbore 200 produces a rapid acceleration of the wireline tool assembly 212 in the downhole direction. The rapid acceleration of the wireline tool assembly 212 during freefall causes axial movement of the activation ring 130 relative to the tool body 110 of the tool brake assembly 100. Axial translation of the activation ring 130 relative to the tool body 110 causes the actuator 160 to move the stop mechanism 140 from the stowed position to the deployed position. In the deployed position, the stop mechanism 140 contacts the wellbore wall 202 or liner 204 (FIG. 2) installed in the wellbore 200 to slow and stop translation of the wireline tool assembly 212 through the wellbore 200 in the downhole direction (i.e., in the −Z direction of the coordinate axis in FIG. 2).

The tool brake assembly 100 of the present disclosure may reduce or prevent damage or loss of wireline tools 214 in the event of separation of the wireline tool assembly 212 from the wireline 210. The tool brake assembly 100 of the present disclosure may further reduce or prevent the wireline tool assembly 212 from getting stuck in the wellbore 200 by providing controlled stopping of the wireline tool assembly 100. Quickly stopping the wireline tool assembly 212 in the event of separation may make it easier to fish the wireline tool assembly 212 from the wellbore 100 to recover the wireline tools 214. The tool brake assembly 100 is a simple design with fast actuation, which enables the stop mechanism 140 to be engaged in the deployed position more quickly compared to other prior art devices with more complex devices for detecting freefall and stopping the device. The faster actuation of the tool brake assembly 100 of the present disclosure may reduce the distance of travel of the wireline tool assembly 212 in the wellbore 200 if detached. This reduces damages from collision with other downhole structures, and makes fishing easier because the wireline tool assembly 212 is stopped closer to where it is expected to be within the wellbore 200, among other features.

Referring again to FIG. 1, the tool brake assembly 212 of the present disclosure may include the tool body 110, the activation ring 130, the stop mechanism 140, and the actuator 160. In embodiments, the tool brake assembly 212 may further include the biasing mechanism 150. The tool body 110 has an uphole end 102 and a downhole end 104. The tool body 110 may include a base 120 at the downhole end 104. The base 120 may have an outer diameter that is greater than an inner diameter the activation ring 130. The base 120 may provide a downhole boundary for axial travel of the activation ring 130 relative to the tool body 110. In other words, an upper surface of the base 120 may prevent the activation ring 130 from moving axially past the downhole end 104 of the tool body 110 and becoming separated from the tool body 110. The base 120 may include a downhole connection 124, which may facilitate attachment of one or more wireline tools to the downhole end 104 of the tool brake assembly 100. In embodiments, the downhole connection 124 may be a threaded connection. Other types of connections are contemplated for the downhole connection 124.

The tool body 110 further comprises a cylindrical wall section 112 coupled to the base 120 and extending axially from the base 120 in the uphole direction (i.e., in the +Z direction of the coordinate axis in FIG. 1 from the base 120). The cylindrical wall section 112 may have an outer surface 111. The outer surface 111 may have a cross-sectional shape, which is a shape of the outer surface 111 in a plane perpendicular to the axial direction (i.e., perpendicular to the +/−Z direction of the coordinate axis in FIG. 1). The cross-sectional shape of the outer surface 111 may be circular, square, polygonal, oval, or any other suitable shape. In embodiments, the outer surface 111 of the cylindrical wall section 112 may be generally circular having a constant radius from a center axis A of the tool body 110. The center axis A of the tool body 110 may be generally parallel to the +/−Z direction of the coordinate axis in FIG. 1. The outer surface 111 of the cylindrical wall section 112 may extend axially from the base 120 in the uphole direction and may be generally parallel to the center axis A of the tool body 110.

Figure 3:
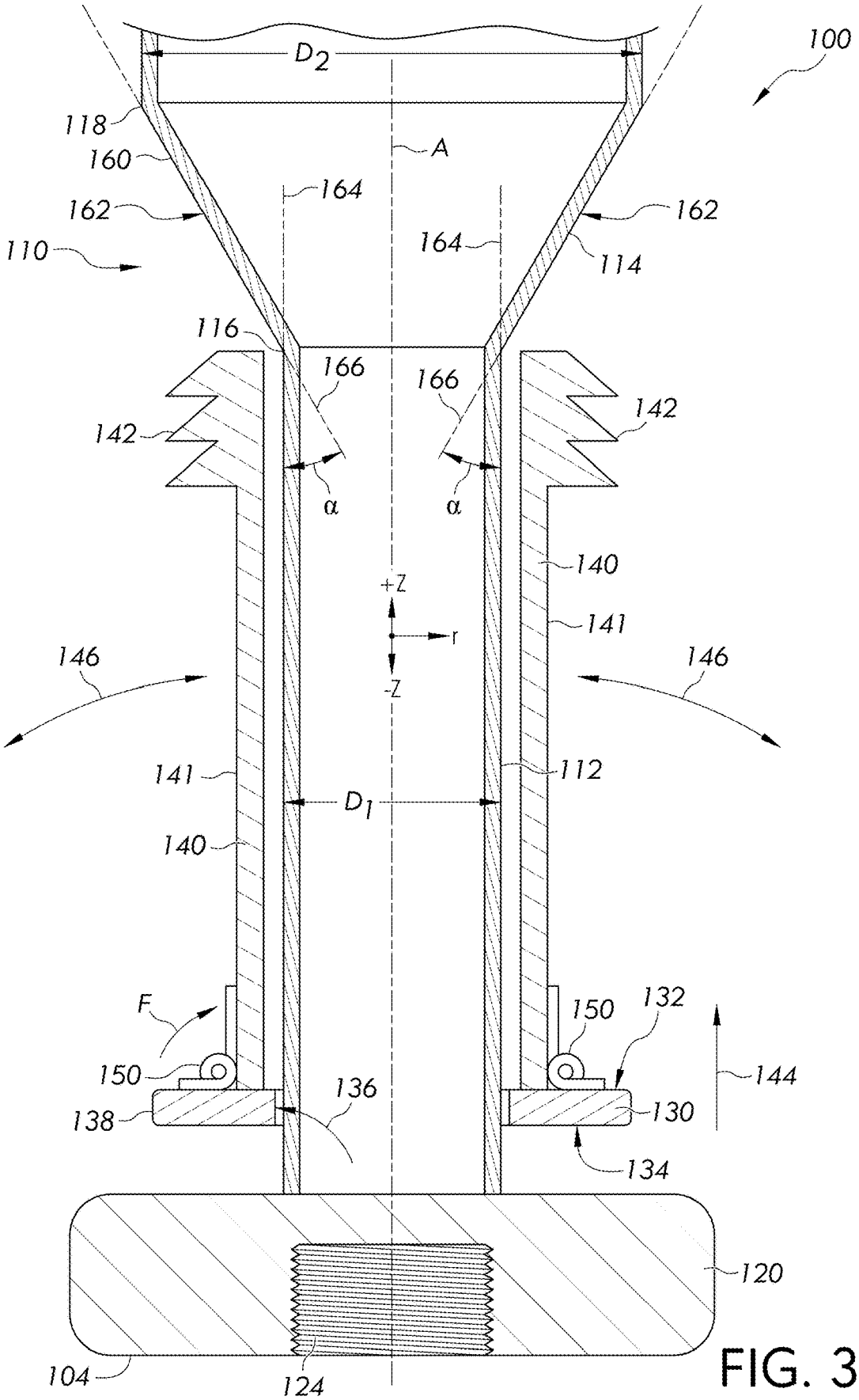
FIG. 3 schematically depicts a side cross-sectional view of the tool brake assembly of FIG. 1 with a stop mechanism of the tool brake assembly in a stowed position, according to embodiments shown and described in this disclosure.

Referring again to FIG. 1, the tool body 110 may have an upper flange 126 at the uphole end 102 of the tool brake assembly 100. The upper flange 126 may have an outer diameter that is greater than the outer diameter of the cylindrical wall section 112. The uphole flange 126 may have an outer diameter that is greater than an inner diameter of the inner radial surface 136 of the activation ring 130. In embodiments, the uphole flange 126 may provide an uphole boundary for axial translation of the activation ring 130 relative to the tool body 110. Referring now to FIG. 3, the upper flange 126 may include an uphole connection 122, which may facilitate attachment of the wireline 210 or a wireline tool 214 to the uphole end 102 of the tool brake assembly 100. In embodiments, the uphole connection 122 may be a threaded connection. Other types of connections or connectors are contemplated for the uphole connection 122.

Referring again to FIG. 1, in embodiments, the tool body 110 may also include a conical wall section 114 disposed uphole from the cylindrical wall section 112, such as between the cylindrical wall section 112 and the upper flange 126. The conical wall section 114 may be rigidly attached to the cylindrical wall section 112. The conical wall section 114 may have a downhole end 116 and an uphole end 118. The conical wall section 114 may have a conical shape so that an outer diameter of the conical wall section 114 is smallest at the downhole end 116 and greatest at the uphole end 118 and gradually increases from the downhole end 116 to the uphole end 118.

Referring now to FIG. 3, in embodiments, the conical wall section 114 may have a first diameter $D_1$ at the downhole end 116 and a second diameter $D_2$ at the uphole end 118. The second diameter $D_2$ may be larger than the first diameter $D_1$. In embodiments, the first diameter $D_1$ may be equal to an outer diameter of the cylindrical wall section 112. The conical wall section 114 may provide an upper boundary for axial travel of the activation ring 130. In other words, the increasing diameter of the outer surface of the conical wall section 114 may prevent the activation ring 130 from translating axially uphole relative to the tool body 110 and beyond the uphole end 118 of the conical wall section 114. An outer surface of the conical wall section 114 may form a non-zero angle $\alpha$ with the outer surface 111 of the cylindrical wall section 112. In other words, a first line 164 on the outer surface 111 of the cylindrical wall section 112 and a second line 166 on the outer surface of the conical wall section 114 intersect and form the non-zero angle $\alpha$. The first line 164 is parallel with the center axis A and congruent with the outer surface 111 of the cylindrical wall section 112, and the second line 166 is congruent with the outer surface of the conical wall section 114 and intersects the first line 164 and the center axis A. The non-zero angle $\alpha$ of the conical wall section 114 may be selected to account for the intended application of the wireline tool assembly 212, the size of the wireline tool assembly 212 and/or tool brake assembly 100, material properties of the fluids in the wellbore 200, the desired operational performance of the tool brake assembly 100, or combinations of these factors. In embodiments, the non-zero angle $\alpha$ between the conical wall section 114 and the cylindrical wall section 112 may be from 5 degrees to 15 degrees.

In embodiments, the upper flange 126 may be coupled to the uphole end 118 of the cylindrical wall section 114. The outer diameter of the upper flange 126 may be greater than the second diameter $D_2$ at the uphole end 118 of the cylindrical wall section 114. The tool body 110 may be solid or hollow. Referring again to FIG. 3, in embodiments, at least a portion of the tool body 110 may be hollow and may comprise an annular wall that defines an interior of the tool body 110. In embodiments, the cylindrical wall section 112, the conical wall section 114, or both may be hollow and defined by the annular wall.

Figure 4:
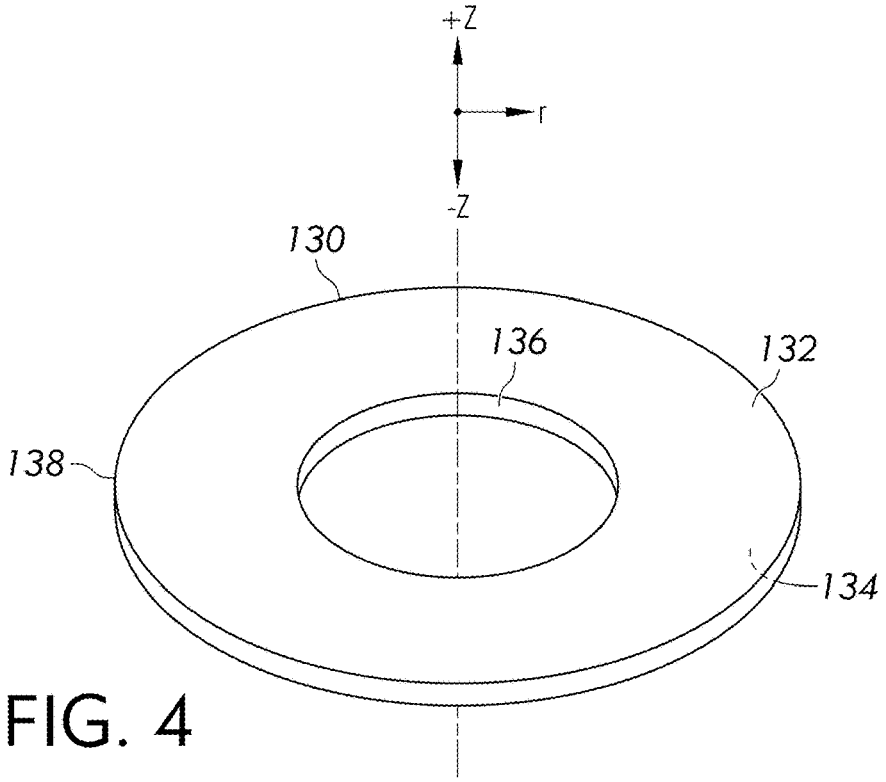
FIG. 4 schematically depicts a perspective view of an activation ring of the tool brake assembly of FIG. 3, according to embodiments shown and described in this disclosure.
Figure 5:
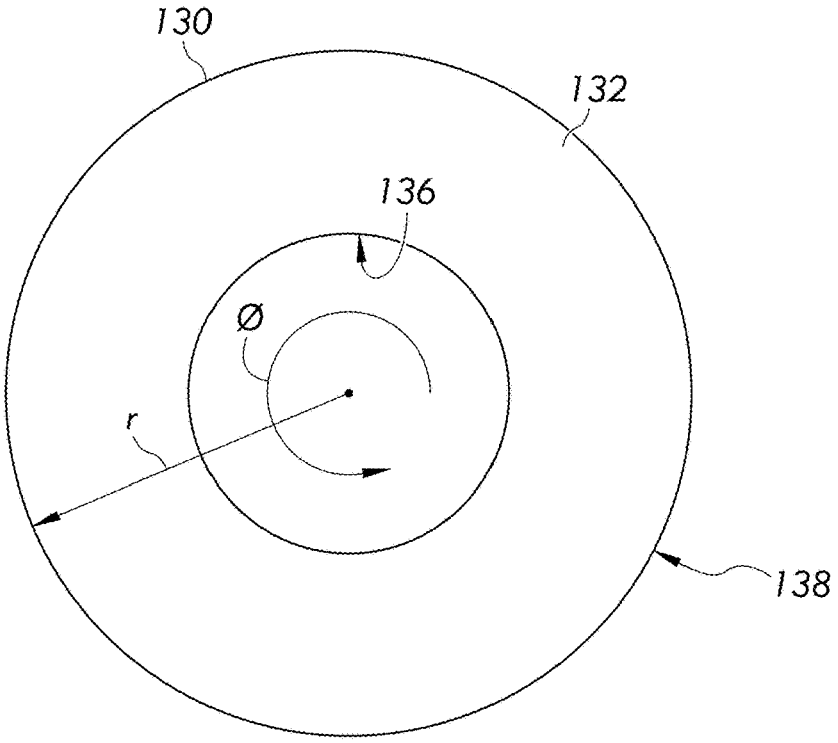
FIG. 5 schematically depicts a top view of the activation ring of the tool brake assembly of FIG. 4, according to embodiments shown and described in this disclosure.

Referring again to FIGS. 1 and 3, the tool brake assembly 100 may further include the activation ring 130, which may surround the cylindrical wall section 112. Referring now to FIGS. 4 and 5, the activation ring 130 may be an annular ring having a top surface 132, a bottom surface 134, an inner radial surface 136, and an outer radial surface 138. The inner radial surface 136 of the activation ring 130 may define an opening extending axially through the activation ring 130. Referring again to FIG. 3, the inner radial surface 136 may have a shape complimentary to the outer surface of the cylindrical wall section 112 of the tool body 110. When assembled, the cylindrical wall section 112 may be received through the opening in the activation ring 130 defined by the inner radial surface 136 such that the activation ring 130 circumscribes the cylindrical wall section 112 of the tool body 110. The activation ring 130 is detached from the cylindrical wall section 112 and is movable in an axial direction (i.e., the +/−Z direction of the coordinate axis in FIG. 3) relative to the tool body 110.

The inner radial surface 136 of activation ring 130 may have a shape that is complimentary to the outer surface 111 of the cylindrical wall section 112. In embodiments, the inner radial surface 136 of the activation ring 130 may have a cross-sectional shape that is circular, where the cross-sectional shape is the shape of the inner radial surface 136 in a plane perpendicular to the center axis A of the tool brake assembly 100. The inner radial surface 136 of the activation ring 130 may have dimensions that enable the activation ring 130 to fit snugly around the cylindrical wall section 112 of the tool body 110, while allowing for unimpeded axial movement of the activation ring 130 relative to the tool body 110. In embodiments, the inner radial surface 136 may have an inner dimension just slightly larger than the outer diameter of the outer surface 111 of the cylindrical wall section 112.

In embodiments, the inner radial surface 136 of the activation ring 130 may have specific dimensions and clearances that cause the activation ring 130 to remain stationary during normal operation but allow the activation ring 130 to move axially relative to the tool body 110 when the wireline tool assembly 212 becomes detached from the wireline 210 in the wellbore 200. In embodiments, a clearance between the activation ring 130 and the outer surface 111 of the cylindrical wall section 112 of the tool body 110 may be from 5% to 15% of the outer diameter of the cylindrical wall section 112, such as from 5% to 12%, from 5% to 10%, from 7% to 15%, from 7% to 12%, or from 7% to 10%. The clearance between the activation ring 130 and the outer surface 111 of the cylindrical wall section 112 may be tailored based on the downhole conditions of the wellbore, such as but not limited to the type of fluid in the wellbore, debris in the wellbore, temperature, pressure, or other condition. When the clearance between the inner radial surface 136 of the activation ring 130 and the outer surface 111 of the cylindrical wall section 112 is too great, the activation ring 130 may have a tendency to move axially relative to the tool body 110 during normal operation, which may cause actuation of the stop mechanism 140 when undesirable to do so. If the clearance between the inner radial surface 136 of the activation ring 130 and the outer surface 111 of the cylindrical wall section 112 is too small, interaction between the inner radial surface 136 of the activation ring 130 and the outer surface 111 of the cylindrical wall section 112 may impede axial movement of the activation ring 130 in the event that the wireline tool assembly 212 is detached from the wireline 210. In the case of clearances that are too small, fluid forces acting on the activation ring 130, such as buoyancy forces, may not be sufficient to overcome frictional forces between the inner radial surface 136 of the activation ring 130 and the outer surface 111 of the cylindrical wall section 112 of the tool body 110, thus, restricting or preventing axial movement activation ring 130 relative to the tool body 110.

The specific shape of the activation ring 130 may facilitate axial movement of the activation ring 130 and ensure proper actuation and operation of the stop mechanism 140 in the event of separation of the wireline tool assembly 212 from the wireline 210. Referring again to FIGS. 4 and 5, the bottom surface 134 of the activation ring 130 may have a shape that enables the activation ring 130 to contact a fluid in the wellbore 200 and cause the fluid to exert buoyancy forces on the activation ring 130 during freefall of the tool brake assembly 100. The bottom surface 134 refers to the surface of the activation ring 130 facing in the downhole direction (i.e., the −Z direction of the coordinate axis in the figures) when the tool brake assembly 100 is positioned in the wellbore 200. In embodiments, the bottom surface 134 of the activation ring 130 may have a flat shape that enables fluids in the wellbore 200 to contact the bottom surface 134 of the activation ring 130 during freefall of the tool brake assembly 100.

The top surface 132 of the activation ring 130 may have a shape that enables interaction between the activation ring 130 and the stop mechanism 140, actuator 160, or both. The top surface 132 of the activation ring 130 refers to the surface of the activation ring 130 that faces in the uphole direction (i.e., the +Z direction of the coordinate axis in the figures) when the tool brake assembly 100 is positioned within the wellbore 200. In embodiments, the top surface 132 of the activation ring 130 may be generally flat to allow for attachment of the stop mechanism 140 directly or indirectly to the top surface 132 of the activation ring 130. The flat shape of the top surface 132 may ensure that that activation ring 130 reliably triggers the stop mechanism 140, the actuator 160, or both. In embodiments, the activation ring 130 may be an annular disc or ring having the top surface 132 and the bottom surface 134 that are both flat.

The activation ring 130 may have a weight distribution that is engineered to respond to changes in the speed of movement of the tool brake assembly 100 within the wellbore 200. The activation ring 130 may have a weight distribution that is calibrated so that the activation ring 130 remains stable in a fixed position under normal operating conditions of the wireline tool assembly 212 conducted at normal speeds within the wellbore but enables the activation ring 130 to move axially relative to the tool body 110 during rapid downhole acceleration of the wireline tool assembly 212, such as the rapid acceleration experienced during a freefall scenario. In embodiments, the activation ring 130 may have a weight distribution in which the mass of the activation ring 130 is distributed to ensure that the activation ring 130 remains balanced during normal movement of the tool brake assembly 100 and wireline tool assembly 212. The weight distribution of the activation ring 130 may cause the activation ring 130 to experience buoyancy forces greater than the tool body 110 when the tool brake assembly 100 experiences rapid acceleration during freefall of the wireline tool assembly 212 in the wellbore 200.

In embodiments, the activation ring 130 may be constructed of a material different from a material of construction of the tool body 110. The different material of the activation ring 130 may provide the activation ring 130 with a buoyancy different from a buoyancy of the tool body 110 when subjected to freefall within a fluid in the wellbore 200. The activation ring 130 may be constructed of a material capable of withstanding the harsh downhole environment, such as but not limited to high pressure conditions, high temperature conditions, corrosive conditions, other harsh conditions, or combinations thereof. In embodiments, the activation ring 130 may be constructed of a high-carbon content steel (steel having a high carbon content). In embodiments, the activation ring 130 may be constructed of high-carbon content steel having a carbon content of from 0.6 weight percent (wt. %) to 1.0 wt. % per unit weight of the high-carbon content steel.

The activation ring 130 may have a density that is less than the density of the tool body 110. The difference in density of the activation ring 130 compared to the tool body 110 may provide for greater buoyancy of the activation ring 130 relative to the tool body 110 when the tool brake assembly 100 is submerged in fluids contained within the wellbore 200. The material of construction for the activation ring 130 may be a high-carbon content steel, which has a density sufficient to achieve the desired specific weight distribution of the activation ring 130 relative to the tool body 110. In embodiments, the activation ring 130 may have a density that is from 50 kg/m$^3$ to 150 kg/m$^3$ less than the density of the tool body 110, such as from 50 kg/m$^3$ to 125 kg/m$^3$, from 50 kg/m$^3$ to 100 kg/m$^3$, from 75 kg/m$^3$ to 150 kg/m$^3$, from 75 kg/m$^3$ to 125 kg/m$^3$, from 75 kg/m$^3$ to 100 kg/m$^3$ less than the density of the tool body 110. The difference between the density of the activation ring 130 and the tool body 110 may be selected based on the operating conditions in the wellbore 200 (type of fluid in the wellbore, temperature, pressure, etc.) or performance requirements of the tool brake assembly 100.

In embodiments, the specific weight distribution of the activation ring 130 can be tailored to the specific fluid contained within the wellbore 200. Examples of fluids that could be present in the wellbore 200 include but are not limited to drilling fluids, spacer fluids, crude oil, produced water, mixtures of water and oil, remediation fluids, or other types of fluids. Each of these fluids may have a different density, viscosity, or both. The specific weight distribution of the activation ring 130 can be selected or designed for the particular fluid expected to be present in the wellbore 200 to account for the specific density, viscosity, or both of the fluid in the wellbore 200, which can affect the axial movement of the activation ring 130 and dynamics of the stop mechanism 140. In particular, the density of the wellbore fluid affects the buoyancy forces acting on the activation ring 130. In denser fluids, the activation ring 130 will experience greater buoyancy, reducing its effective weight. To counteract the greater buoyancy experienced in denser fluids, the weight distribution of the activation ring 130 may be adjusted to ensure that the activation ring 130 stays in a fixed position during normal operation and translates axially only in response to rapid acceleration during freefall. The selection of the activation ring 130 shape and density to change the weight distribution of the activation ring 130 may be based on historical wellbore data for each subterranean formation (reservoir) or wellbore 200 to ensure optimal performance of the tool brake assembly 100. This wellbore data includes factors such as fluid density, viscosity, pressure, and temperature, which directly influence the weight distribution and movement of the activation ring 130. By analyzing well-specific conditions, the appropriate ring material, weight distribution, and design adjustments can be made to suit the unique characteristics of the subterranean formation and wellbore 200.

Referring again to FIG. 3, during normal operation of the wireline tool assembly 212, the activation ring 130 may rest in a stationary position proximate to the base 120 at the downhole end 104 of the tool brake assembly 100. During normal operation of the wireline tool assembly 212 in the wellbore 200 filled with hydrocarbons, the wireline tool assembly 212 may travel through the wellbore 200 with controlled accelerations in a range of from 0 meters per second squared (m/s$^2$) to about 1 m/s$^2$, which are accomplished through steady lowering the pulling speeds. The lighter density and viscosity of hydrocarbon fluids, compared to the activation ring 130, create some drag, which slightly reduces the overall accelerations experienced by the wireline tool assembly 212. In the event of a free fall, the wireline tool assembly 212 can accelerate rapidly, but due to the damping effects of the fluid in the wellbore 200, the acceleration of the wireline tool assembly 212 can reach around 5 m/s$^2$ to 8 m/s$^2$. When subjected to a freefall condition, such as would be caused by detachment of the wireline tool assembly 212 from the wireline 210, the rapid acceleration of the tool brake assembly 100 in the downhole direction (−Z direction of the coordinate axis in FIG. 3) creates buoyancy forces sufficient to cause the activation ring 130 to move axially relative to the tool body 110 towards the uphole end 102 of the tool body 110. As the activation ring 130 moves axially relative to the tool body 110, the cylindrical wall section 112 acts as a guide to guide the axial movement of the activation ring 130 relative to the tool body 110. Translation of the activation ring 130 along the cylindrical wall section 112 may enable smooth and predictable activation of the stop mechanism 140.

Figure 6:
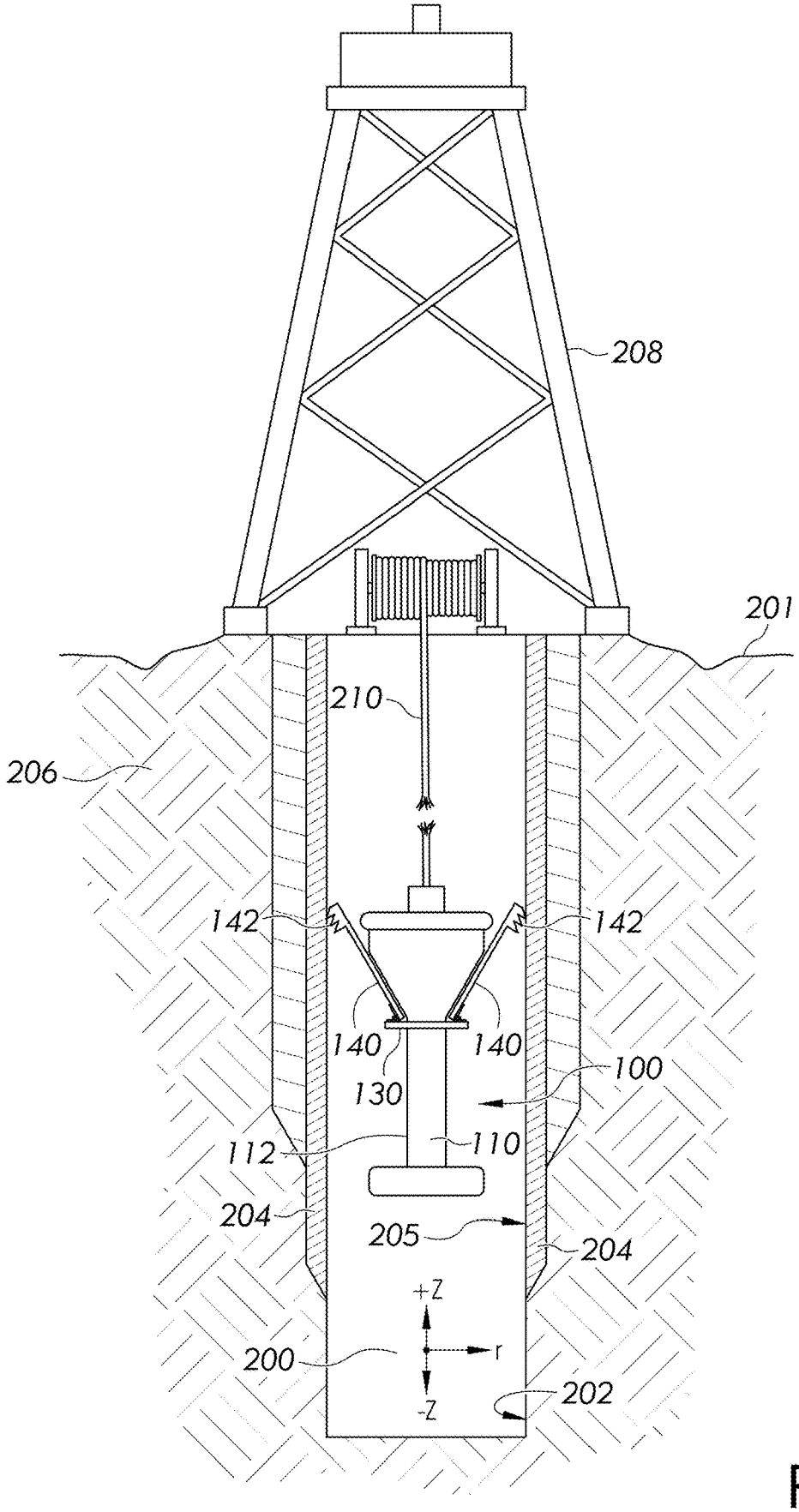
FIG. 6 schematically depicts the tool brake assembly of FIG. 3 within the subterranean wellbore and having the stop mechanism in a deployed position, according to embodiments shown and described in this disclosure.

Referring again to FIG. 1, the stop mechanism 140 is operatively coupled to the activation ring 130 or to the actuator 160. The stop mechanism 140 may be configured to move between a stowed position and a deployed position. In embodiments, the stop mechanism 140 may be attached directly or indirectly to the top surface 132 of the activation ring 130. In the stowed position, the stop mechanism 140 may be retracted against the tool body 110 to allow the tool brake assembly 100 and the wireline tool assembly 212 to translate axially through the wellbore 200. In embodiments, the stop mechanism 140 may have no parts or structures that extend radially outward beyond an outer radius of the base 120 of the tool brake assembly 100 when the stop mechanism 140 is in the stowed position. The stop mechanism 140 may interact with the wellbore wall 202 in the deployed position. Referring now to FIG. 6, when the stop mechanism 140 is in the deployed position, at least a portion of the stop mechanism 140 may extend radially outward from the tool brake assembly 100 and into contact with the wellbore wall 202 or an inner surface 205 of the liner 204 installed in the wellbore 200.

In embodiments, the stop mechanism 140 may comprise a plurality of rods 141 operatively coupled to the activation ring 130. The stop mechanism 140 may have 2, 3, 4, or more than 4 rods 141. Each of the rods 141 may have a length that enables an outer end of the rods 141 to contact the wellbore wall 202 or inner surface 205 of the liner 204 when the rods 141 are in the deployed position. The plurality of rods 141 may be distributed evenly about the circumference of the tool body 110 so that, when the rods 141 are in the deployed position, the tool brake assembly 100, wireline tool assembly 212, or both are evenly supported through the multiple contact points with the wellbore wall 202 or inner surface 205 of the liner 204. This may ensure that the wireline tool assembly 212 remains axially oriented in the wellbore 200 with the uphole end 102 facing towards the surface 201 and the downhole end 104 facially axially towards the bottom of the wellbore 200.

In embodiments, the rods 141 of the stop mechanism 140 may be pivotally attached to the activation ring 130. In other words, the rods 141 may be attached to the activation ring 130 in a manner that allows the rods 141 to pivot at one end of the rods 141 to transition between the stowed position and the deployed position. In embodiments, each of the rods 141 may be attached to the activation ring 130 with a hinge (not shown), spring (such as biasing mechanism 150), or other structure that enables the rods 141 to pivot relative to the activation ring 130. Although shown in the Figures as being attached to the activation ring 130, in embodiments, the stop mechanism 140, such as the rods 141, may be pivotally attached directly to the tool body 110 or to any other structures that are rigidly attached to the tool body 110.

The rods 141 may have a grip feature at the outer ends of the rods 141 to provide grip against the wellbore wall 202 or inner surface 205 of the liner 204 when in the deployed position. In embodiments, each of the plurality of rods 141 may have pointed barbs 142 positioned on the outer end. The pointed barbs 142 may engage with the wellbore wall 202 or inner surface 205 of the liner 204 when the stop mechanism 140 is in the deployed position. In embodiments, the rods 141 may have other types of grip features at the outer ends, such as but not limited to brake pads or other structures designed to increase friction between the outer ends of the rods 141 and the wellbore wall 202 or inner surface 205 of the liner 204.

In embodiments, the cylindrical wall section 112 of the tool body 110 may have an axial length that is greater than a length of each of the rods 141 of the stop mechanism 140. This may allow the rods 141 to sit against the cylindrical wall section 112 when in the deployed position.

Referring again to FIG. 3, in embodiments, the tool brake assembly 100 may include the biasing mechanism 150, which may be coupled to the stop mechanism 140 and configured to bias the stop mechanism 140 into the stowed position. In embodiments, the biasing mechanism 150 may be a spring coupled to the rods 141 of the stop mechanism 140 and to the activation ring 130 or to the tool body 110. In embodiments, the biasing mechanism 150 may be a torsion spring. In embodiments, the torsion spring of the biasing mechanism 150 may be directly attached to the rods 141 of the stop mechanism 140 and directly attached to the top surface 132 of the activation ring 130. The torsion spring may have sufficient force F to bias the rods 141 into the stowed position during normal operation, but may allow for the rods 141 to pivot radially outward into the deployed position in response to activation by the activation ring 130, such as in response to axial movement of the activation ring 130 relative to the tool body 110.

The tool brake assembly 100 may comprise the actuator 160. The actuator 160 may be operatively coupled to or integral with the tool body 110. The actuator 160 may be configured to cause the stop mechanism 140 to move from the stowed position to the deployed position when the activation ring 130 travels axially relative to the tool body 110. In embodiments, the actuator 160 may comprise a hydraulic actuator, a mechanical linkage, an angled surface, other type of actuator 160, or any combination of actuators.

Referring again to FIG. 3, in embodiments, the actuator 160 may be one or more angled surfaces 162 integrated into the tool body 110 and disposed proximate the uphole end 102 of the tool body 110. The angled surfaces 162 may be positioned and configured to force the stop mechanism 140 to pivot into the deployed position when the activation ring 130 translates axially relative to the tool body 110 towards the uphole end 102 of the tool body 110. The angled surface 162 may be a surface that intersects the outer surface 111 of the cylindrical wall section 112, where the first line 164 on the outer surface 111 of the cylindrical wall section 112 and the second line 166 on the angled surface 162 intersect and form the non-zero angle $\alpha$. The first line 164 is parallel with the center axis A and congruent with the outer surface 111 of the cylindrical wall section 112, and the second line 166 is congruent with the angled surface 162 and intersects the first line 164 and the center axis A. The non-zero angle $\alpha$ of the angled surface 162 may be selected to account for the intended application of the wireline tool assembly 212, the size of the wireline tool assembly 212 and/or tool brake assembly 100, material properties of the fluids in the wellbore 200, the desired operational performance of the tool brake assembly 100, or combinations of these factors. In embodiments, the non-zero angle $\alpha$ between the angled surface 162 and the cylindrical wall section 112 may be from 5 degrees to 15 degrees.

In embodiments, the angled surface 162 of the actuator 160 may be the conical wall section 114 of the tool body 110. The conical wall section 114 has an outer surface that may provide the angled surface 162 capable of transitioning the stop mechanism 140 from the stowed position to the deployed position. In embodiments, movement of the activation ring 130 relative to the tool body 130 may cause the outer ends of the rods 141 of the stop mechanism 140 to contact the angled surface 162, which may be the outer surface of the conical wall section 114. The contact between the outer ends of the rods 141 and the angled surface 162, in cooperation with continued axial translation of the activation ring 130 in the direction uphole relative to the tool body 110 (i.e., axial movement of the activation ring 130 towards the uphole end 102 of the tool body 110), may cause the rods 141 to overcome the biasing force from the biasing mechanism 150 and pivot or rotate radially outward, which extends the outer ends of the rods 141 radially outward into the deployed position in which the outer ends of the rods 141 contact the wellbore wall 202 or the inner surface 205 of the liner 204.

Figure 7:
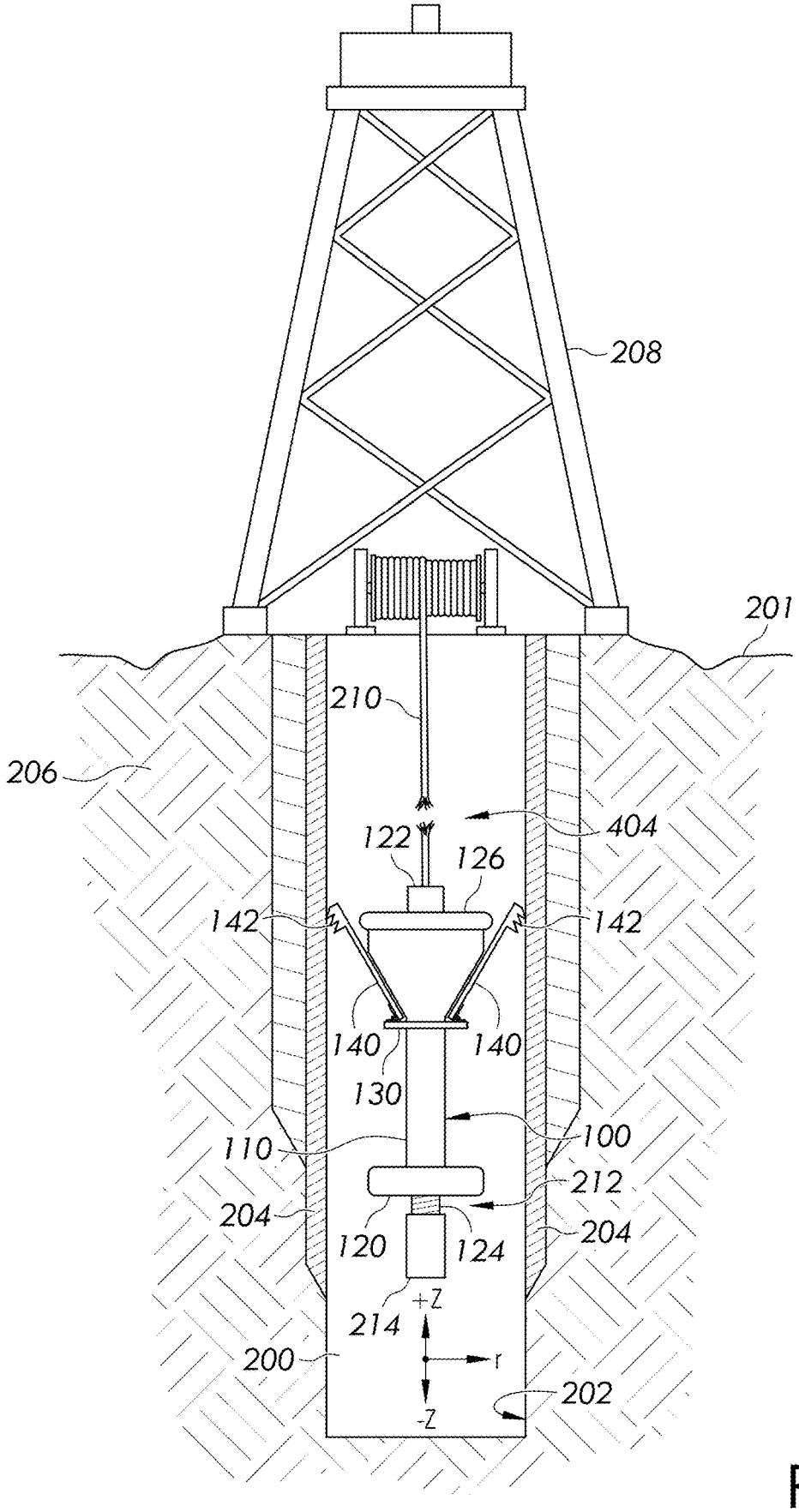
FIG. 7 schematically depicts a wireline tool assembly comprising the tool brake assembly of FIG. 3 and a wireline tool coupled to a downhole end of the tool brake assembly, according to embodiments shown and described in this disclosure.

Referring now to FIG. 7, in embodiments, the wireline tool assembly 212 may include the tool brake assembly 100 of the present disclosure and one or more wireline tools 214. The term "wireline tool assembly" used herein is intended to refer to the collection of structures attached to the wireline 210 or slickline, said structures include the tool brake assembly 100, one or more wireline tools 214, other types of devices, or combinations thereof. In embodiments, the wireline tools 214 may be coupled to the tool brake assembly 100 uphole or downhole of the tool brake assembly 100 using the uphole connection 122 or downhole connection 124. In embodiments, the wireline tools 214 may be coupled to the downhole end 104 of the tool body 110 of the tool brake assembly 100 using the downhole connection 124. The wireline tools 214 may include but are not limited to one or more data logging devices, perforation devices, sampling devices, other device, or any combinations of these devices. The wireline tool assembly 212 may be connected to a wireline or slickline during normal operation of the wireline tool assembly 212.

Referring again to FIGS. 1 and 3, in embodiments, the tool body 110 may have a main body 119, which may be disposed uphole or downhole of the cylindrical wall section 112. In embodiments, the main body 119 may be disposed between the cylindrical wall section 112 and the upper flange 126. In embodiments, the main body 119 may be hollow and may contain one or more of the wireline tools 214, which may be disposed in an interior cavity of the main body 119 or integrated with the main body 119 of the tool brake assembly 100. Tools disposed in the main body 119 may include but are not limited to data loggers, sampling devices, perforation devices, or other types of tools used in downhole operation. In embodiments, the main body 119 may be configured to accommodate the tools, such as having ports for sampling, sensors for detecting wellbore conditions, or perforation devices integrated into the main body 119, or other features for integrating one or more wireline tools into the tool body 110.

Figure 8C:
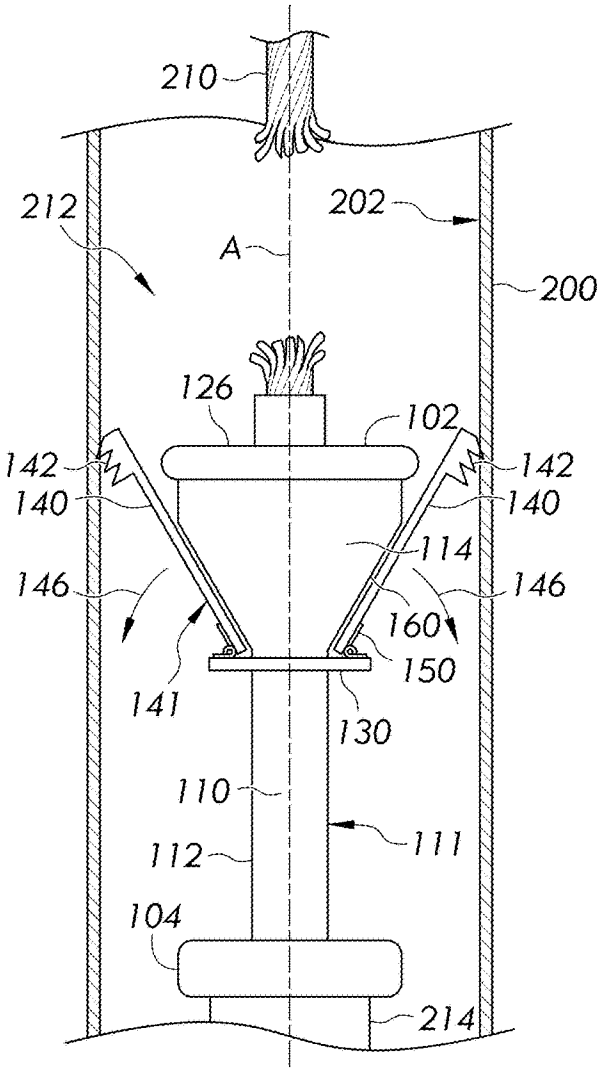
FIG. 8C schematically depicts movement of the stop mechanism of the tool brake assembly of FIG. 8B into a deployed position in response to movement of the activation ring, according to embodiments shown and described in this disclosure.

Operation of the tool brake assembly 100 will be discussed in further detail with reference to FIGS. 8A, 8B, and 8C. Referring to FIG. 8A, during normal operation of the wireline tool assembly 212, the tool brake assembly 100 may have the stop mechanism 140 in the stowed position. As shown in FIG. 8A, in the stowed position, the activation ring 130 may be positioned in a lowered position proximate the base 120 at the downhole end 104 of the tool body 110. The stop mechanism 140 may be biased into the stowed position by the biasing mechanism 150. In embodiments, in the stowed position, the rods 141 of the stop mechanism 140 may have an orientation that is generally aligned with the center axis A of the tool body 110 and may be positioned against the outer surface 111 of the cylindrical wall section 112. In embodiments, in the stowed position, the rods 141 of the stop mechanism 140 may be biased against and into contact with the outer surface 111 of the cylindrical wall section 112. The biasing mechanism 150 may maintain the stop mechanism 140 in the stowed position. In the stowed position, the tool brake assembly 100 may travel freely in the uphole and downhole direction when positioning the wireline tools 214 at various positions within the wellbore 200.

Figure 8B:
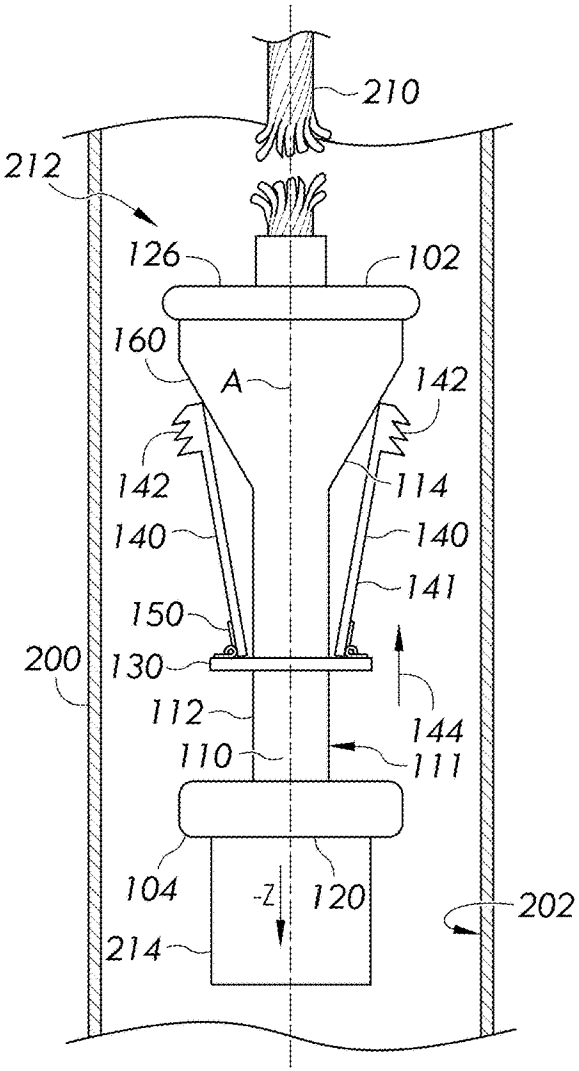
FIG. 8B schematically depicts movement of an activation ring of the tool brake assembly of FIG. 8A in response to a freefall condition, according to embodiments shown and described in this disclosure.
Figure 8A:
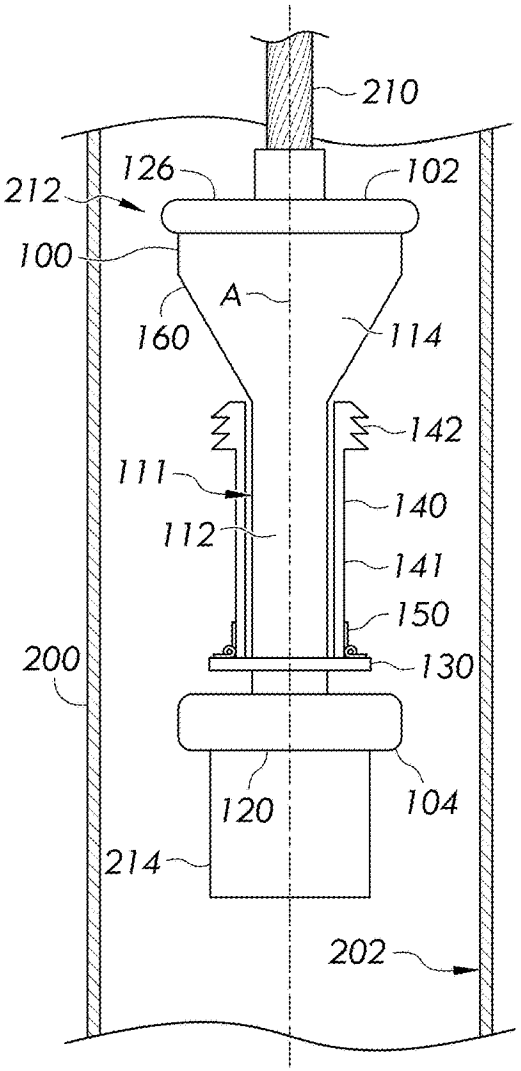
FIG. 8A schematically depicts the tool brake assembly of FIG. 3 having the stop mechanism in the stowed position, according to embodiments shown and described in this disclosure.

Referring now to FIG. 8B, initial separation of the wireline tool assembly 212 from the wireline 210 is schematically depicted. When the wireline tool assembly 212 becomes separated from the wireline 210, the wireline tool assembly 212 experiences a rapid acceleration in the downhole direction (the −Z direction of the coordinate axis in FIG. 8B), which is caused by freefall of the wireline tool assembly 212 in the wellbore 200. The rapid acceleration of the wireline tool assembly 212 having the tool brake assembly 100 may cause the activation ring 130 of the tool brake assembly 100 to translate axially relative to the cylindrical wall section 112 of the tool body 110. Axial translation of the activation ring 130 relative to the tool body 110 is indicated by the arrow 144 in FIG. 8B. The tool body 110 and the activation ring 130 may both be traveling in the downhole direction. However, due to the specific weight distribution of the activation ring 130, the activation ring 130 experiences buoyancy forces different from the buoyancy forces experienced by the tool body 110, which results in the activation ring 130 falling at a speed less than the tool body 110. This difference in speed results in the activation ring 130 moving axially along the cylindrical wall section 112 towards the uphole end 102 of the tool body 110. This is referred to in the present disclosure as the activation ring 130 moving uphole relative to the tool body 110, even though both the tool body 110 and activation ring 130 are traveling downhole. The activation ring 130 is just traveling downhole at a slower speed compared to the tool body 110 due to the difference in buoyancy forces.

In the embodiment shown in FIG. 8B, the actuator 160 is the conical wall section 114 of the tool body 110. The uphole axial movement of the activation ring 130 relative to the tool body 110 may cause the stop mechanism 140 to contact the angled surface 162 provided by the conical wall section 114. In embodiments, the relative axial movement of the activation ring 130 may cause the ends of the rods 141 of the stop mechanism 140 to contact the conical wall section 114. The contact of the stop mechanism 140 with the angled surface 162 of the conical wall section 114 may cause the stop mechanism 140, such as rods 140, to pivot radially outward away from the cylindrical wall section 112 of the tool body 110.

Referring now to FIG. 8C, as the activation ring 130 continues to travel uphole along the cylindrical wall section 112 relative to the tool body 110, the stop mechanism 140, such as rods 141, may continue to pivot radially outward into the deployed position, in which the barbs 142, or other grip features, contact the wellbore wall 202 (or the inner surface of the liner if liner has been installed in that section of the wellbore 200). The pivoting of the rods 141 radially outward into the deployed position is indicated by the arrows 146 in FIG. 8C. The contact between the barbs 142 (or other grip feature) and the wellbore wall 202 (or inner surface of the liner) may slow and stop the wireline tool assembly 212 in the wellbore 200. The weight of the wireline tool assembly 212 may ensure that the stop mechanism 140 is maintained in the deployed position to maintain the wireline tool assembly 212 at the stopped position within the wellbore 200. Activation of the tool brake assembly 100 to deploy the stop mechanism 140 may be fast enough so that the wireline tool assembly 212 is stopped at a position in the wellbore 200 that is not too far downhole from the point where the wireline tool assembly 212 became separated from the wireline 210 or slickline.

With the tool brake assembly 100 activated and the wireline tool assembly 212 stopped at a fixed positon in the wellbore 200, fishing efforts can be undertaken to recover the wireline tool assembly 212 from the wellbore 100. The wireline tool assembly 212 may be fished out of the wellbore 200 by extending a wireline 210 or slickline having a fishing tool disposed on the end into the wellbore 200. In embodiments, the fishing tool (not shown) may be configured to engage with the upper flange 126 of the tool brake assembly 212 or other feature of the wireline tool assembly 212. Once the fishing tool is engaged with the upper flange 126 of the tool brake assembly 212 or other part of the wireline tool assembly 212, the wireline 210, fishing tool, and wireline tool assembly 212 may be pulled uphole. Uphole movement of the wireline 210 and wireline tool assembly 212 may cause the stop mechanism 140 to release from the wellbore wall 202 (or inner surface of the liner). Once released, the stop mechanism 140 may return to the stowed position through operation of the biasing mechanism 150. The activation ring 130 may also return to the normal operation position proximate to the base 120 at the downhole end 104 of the tool body 110.

Figure 9:
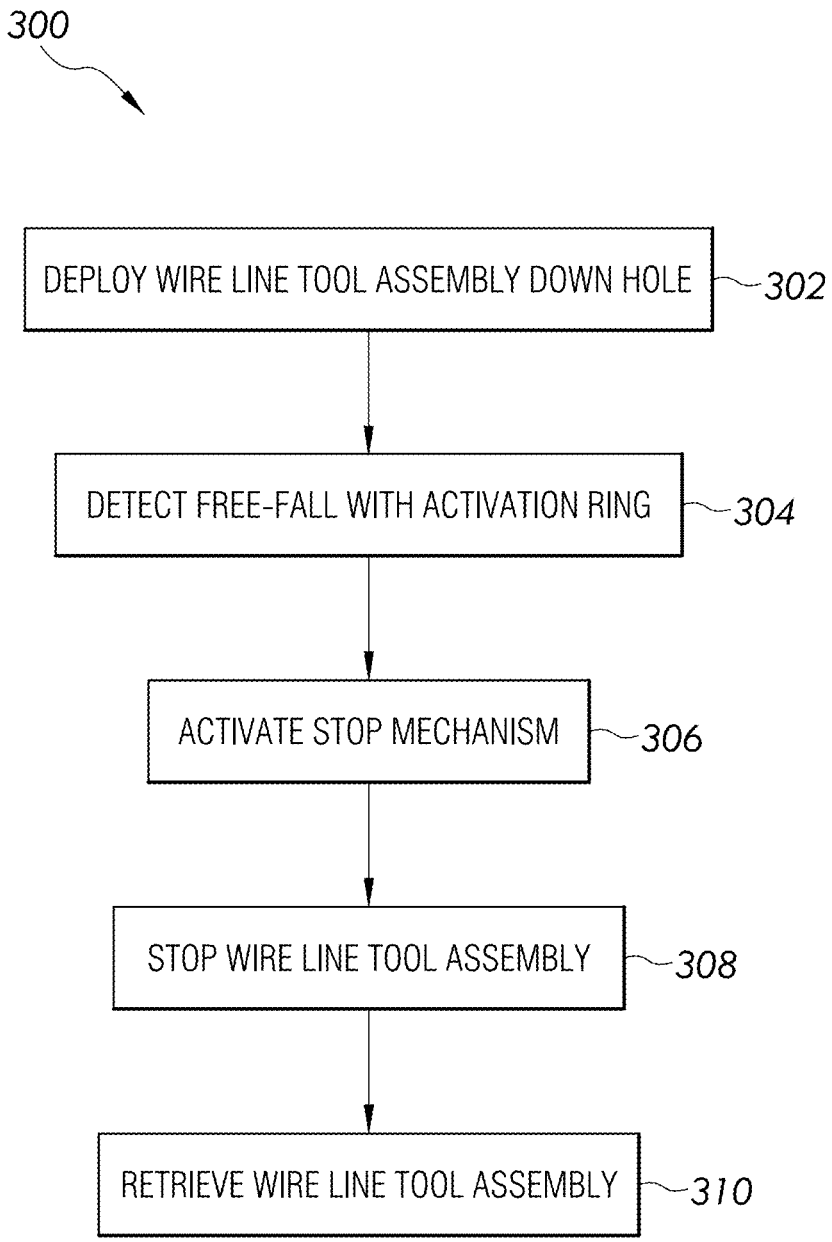
FIG. 9 schematically depicts a flow diagram of a method of operating the tool brake assembly of FIG. 1, according to embodiments shown and described in this disclosure.

Referring now to FIG. 9, one embodiment of a method 300 for using the tool brake assembly of the present disclosure may include deploying a wireline tool assembly comprising the tool brake assembly in a wellbore in step 302. The wireline tool assembly and the tool brake assembly may have any of the features or characteristics described in this disclosure for these assemblies. The methods 300 may further include detecting a freefall condition of the wireline tool assembly with the activation ring in step 304. The freefall condition may be indicative of separation of the wireline tool assembly from the wireline. The methods 300 may further include activating the stop mechanism of the tool brake assembly in response to detecting the freefall condition of the wireline tool assembly in step 306 and stopping the wireline tool assembly in the wellbore in step 308. Activation of the stop mechanism may cause the stop mechanism to contact the wellbore wall or the inner surface of the liner installed in the wellbore, where the contact causes slowing of the freefall and eventual stopping of the wireline tool assembly at a fixed position in the wellbore. The methods may further include retrieving the wireline tool assembly from the fixed position in the wellbore in step 310.

Referring again to FIG. 2, in embodiments, methods of operating the wireline tool assembly 212 in a wellbore 200 extending into a subterranean formation 206 may include making up the wireline tool assembly 212 and attaching the wireline tool assembly 212 to a wireline 210 or slickline. The wireline tool assembly 212 comprises at least one wireline tool 214 and the tool brake assembly 100 of the present disclosure, which may have any of the features or characteristics described in this disclosure for the tool brake assembly 100. The methods may include running the wireline tool assembly 212 downhole into the wellbore 200 and performing one or more operations in the wellbore 200 using the wireline tool 214. The methods may include repositioning the wireline tool assembly 212 within the wellbore 200. Repositioning may include removing the wireline tool assembly 212 from the wellbore 200 as well as changing an uphole or downhole position of the wireline tool assembly 212 to repeat the one or more operations.

Referring now to FIG. 6, running the wireline tool assembly 212 into the wellbore 200, performing one or more operations in the wellbore 200, or repositioning the wireline tool assembly 212 in the wellbore 200 may cause the wireline tool assembly 212 to separate from the wireline 210 or slickline. When the wireline tool assembly 212 becomes separated from the wireline 210 or slickline, freefall of the wireline tool assembly 212 may be automatically detected by the activation ring 130 of the tool brake assembly 100, which may automatically cause the stop mechanism 140 to activate to stop the wireline tool assembly 212 at a fixed position within the wellbore 200. The methods may include fishing the wireline tool assembly 212 from the wellbore 200, where fishing the wireline tool assembly from the wellbore 200 generates an uphole force on the tool brake assembly 100 that releases the stop mechanism 140 from the wellbore wall 202 (or inner surface of the liner). Releasing the stop mechanism 140 may cause the stop mechanism 140 to return to the stowed position. Fishing the wireline tool assembly 212 from the wellbore 200 may include attaching a fishing tool to the end of a wireline 210, running the fishing tool downhole, engaging the fishing tool with the upper flange 126 of the tool brake assembly 100 or other structure of the wireline tool assembly 212, and once engaged, pulling the wireline 210 uphole.

A first aspect of the present disclosure is directed to a wireline tool assembly for operating in a wellbore extending into a subterranean formation. The wireline tool assembly comprises a tool brake assembly, and the tool brake assembly include a tool body comprising a cylindrical wall section having an outer surface and an activation ring having a specific weight distribution, wherein the activation ring circumscribes the outer surface of the cylindrical wall section of the tool body and the activation ring is movable in an axial direction relative to the tool body. The tool brake assembly may further include a stop mechanism coupled to the activation ring or to the tool body and configured to move between a stowed position and a deployed position. The tool brake assembly may further include an actuator operatively coupled to the tool body and configured to cause the stop mechanism to move from the stowed position to the deployed position when the activation ring moves axially relative to the tool body. The specific weight distribution of the activation ring may be configured to cause the activation ring to remain in a fixed position during normal operation of the wireline tool assembly and to move axially relative to the tool body during freefall of the wireline tool assembly. In the deployed position, the stop mechanism extends radially outward from the tool body and into contact with a wellbore wall of the subterranean wellbore to impede translation of the wireline tool assembly axially downward through the wellbore.

A second aspect of the present disclosure may include the first aspect, wherein the activation ring may be constructed of a material different from the tool body.

A third aspect of the present disclosure may include either one of the first or second aspects, wherein the activation ring may comprise steel with a carbon content of from 0.6 wt. % to 1.0 wt. %.

A fourth aspect of the present disclosure may include any one of the first through third aspect, wherein the activation ring may have a density less than a density of the tool body, wherein a difference in the density of the activation ring compared to the density of the tool body provides greater buoyancy of the activation ring relative to the tool body when the wireline tool assembly is submerged in liquids contained within the wellbore.

A fifth aspect of the present disclosure may include the fourth aspect, where the density of the activation ring is from 50 $kg/m^3$ to 150 $kg/m^3$ less than the density of the tool body.

A sixth aspect of the present disclosure may include any one of the first through fifth aspects, wherein the stop mechanism may be attached to the activation ring and may move with the activation ring relative to the tool body.

A seventh aspect of the present disclosure may include the sixth aspect, wherein the actuator may comprise a conical wall section of the tool body, the conical wall section having a first outer diameter at a point where the conical wall section connects to the cylindrical wall section and a second outer diameter disposed uphole from the first outer diameter, where the second diameter may be greater than the first diameter.

An eighth aspect of the present disclosure may include the seventh aspect, wherein when the activation ring moves axially uphole relative to the tool body, the stop mechanism may contact the conical wall section, which may cause the stop mechanism to pivot radially outward into the deployed position.

A ninth aspect of the present disclosure may include any one of the first through sixth aspects, wherein the actuator may be a hydraulic actuator, a mechanical linkage, or a combination of both.

A tenth aspect of the present disclosure may include any one of the first through sixth aspects, wherein the actuator may comprise a hydraulic actuator, wherein, in response to axial movement of the activation ring relative to the tool body, the hydraulic actuator is configured to cause the stop mechanism to extend radially outward from the tool body and into the deployed position.

An eleventh aspect of the present disclosure may include any one of the first through tenth aspects, wherein the stop mechanism may comprise a plurality of rods, wherein each of the plurality of rods may have at least one pointed barb on a radially outer end of the rod, wherein the at least one pointed barb may engage with the wellbore wall when the stop mechanism is in the deployed position.

A twelfth aspect of the present disclosure may include any one of the first through eleventh aspects, further comprising a biasing mechanism coupled to the stop mechanism and to the tool body, wherein the biasing mechanism may be configured to bias the stop mechanism into the stowed position.

A thirteenth aspect of the present disclosure may include any one of the first through twelfth aspects, wherein the biasing mechanism may comprise a spring attached to the stop mechanism and to the activation ring, wherein the spring may bias the stop mechanism into the stowed position.

A fourteenth aspect of the present disclosure may include the thirteenth aspect, wherein the spring may be a torsion spring.

A fifteenth aspect of the present disclosure may include any one of the first through fourteenth aspects, wherein the tool body further may comprise an uphole connection, a downhole connection, or both.

A sixteenth aspect of the present disclosure may include any one of the first through fifteenth aspects, wherein the tool body further may comprise a fishneck flange attached at an uphole end of the tool body.

A seventeenth aspect of the present disclosure may include the fifteenth aspect, wherein the fishneck flange may be attached to an uphole end of the conical body section of the tool body.

An eighteenth aspect of the present disclosure may include any one of the first through seventeenth aspects, further comprising at least one wireline tool coupled to the tool body, wherein the at least one wireline tool may comprise a data logger device, a perforation device, a sampling device, or combinations thereof.

A nineteenth aspect of the present disclosure may include the eighteenth aspect, wherein the at least one wireline tool may be coupled to a downhole connection of the tool body.

A twentieth aspect of the present disclosure may include any one of the first through nineteenth aspects, wherein the actuator may comprise one or more angled surfaces integrated into the tool body and disposed proximate the uphole end of the tool body, where the one or more angled surfaces may be configured to force the stop mechanism to pivot into the deployed position when the activation ring translates axially relative to the tool body towards the uphole end of the tool body.

A twenty-first aspect of the present disclosure may include the twentieth aspect, wherein: the angled surface may be a surface that intersects the outer surface of the cylindrical wall section; a first line on the outer surface of the cylindrical wall section and a second line 166 on the angled surface 162 may intersect and form a non-zero angle $\alpha$; the first line 164 may be parallel with the center axis A and congruent with the outer surface 111 of the cylindrical wall section 112; the second line 166 is congruent with the angled surface 162 and intersects the first line 164 and the center axis A; and the non-zero angle $\alpha$ is from 5 degrees to 15 degrees.

A twenty-second aspect of the present disclosure may include any one of the first through twenty-first aspects, wherein a clearance between the activation ring and the outer surface of the cylindrical wall section of the tool body may be from 5% to 15% of the outer diameter of the cylindrical wall section.

A twenty-third aspect of the present disclosure may include any one of the first through twenty-second aspects and may be directed to a method for operating the wireline tool assembly of any one of the first through twenty-second aspects in a wellbore extending into a subterranean formation. The method may comprise making up the wireline tool assembly comprising the tool brake assembly and at least one wireline tool; attaching the wireline tool assembly to a wireline or slickline; running the wireline tool assembly downhole into the wellbore; and performing one or more operations in the wellbore with the at least one wireline tool or repositioning the wireline tool assembly in the wellbore. Running the wireline tool assembly into the wellbore, performing one or more operations in the wellbore, or repositioning the wireline tool assembly in the wellbore may cause the wireline tool assembly to separate from the wireline or slickline. When the wireline tool assembly becomes separated from the wireline or slickline, the activation ring may automatically detect the freefall of the wireline tool assembly, and the actuator may automatically transition the stop mechanism from the stowed position to the deployed position, which stops the wireline tool assembly at a fixed position within the wellbore.

A twenty-fourth aspect of the present disclosure may include the twenty-third aspect, further comprising, fishing the wireline tool assembly from the fixed position in the wellbore.

It is noted that any two quantitative values assigned to a property may constitute a range of that property, and all combinations of ranges formed from all stated quantitative values of a given property are contemplated in this disclosure.

Having described the subject matter of the present disclosure in detail and by reference to specific aspects, it is noted that the various details of such aspects should not be taken to imply that these details are essential components of the aspects. Rather, the claims appended hereto should be taken as the sole representation of the breadth of the present disclosure and the corresponding scope of the various aspects described in this disclosure. Further, it will be apparent that modifications and variations are possible without departing from the scope of the appended claims.

What is claimed is:

1. A wireline tool assembly for operating in a wellbore extending into a subterranean formation, the wireline tool assembly comprising a tool brake assembly, wherein the tool brake assembly comprises:

a tool body comprising a cylindrical wall section having an outer surface;

a activation ring having a specific weight distribution, wherein the activation ring circumscribes the outer surface of the cylindrical wall section of the tool body and the activation ring is movable in an axial direction relative to the tool body;

a stop mechanism coupled to the activation ring or to the tool body and configured to move between a stowed position and a deployed position; and an actuator operatively coupled to the tool body and configured to cause the stop mechanism to move from the stowed position to the deployed position when the activation ring moves axially relative to the tool body;

wherein:

the specific weight distribution of the activation ring is configured to cause the activation ring to remain in a fixed position during normal operation of the wireline tool assembly and to move axially relative to the tool body during freefall of the wireline tool assembly; and in the deployed position, the stop mechanism extends radially outward from the tool body and into contact with a wellbore wall of the subterranean wellbore to impede translation of the wireline tool assembly axially downward through the wellbore.

2. The wireline tool assembly of claim 1, wherein the activation ring is constructed of a material different from the tool body.

3. The wireline tool assembly of claim 1, wherein the activation ring comprises steel with a carbon content of from 0.6 wt % to 1.0 wt %.

4. The wireline tool assembly of claim 1, wherein the activation ring has a density less than a density of the tool body, wherein a difference in the density of the activation ring compared to the density of the tool body provides greater buoyancy of the activation ring relative to the tool body when the wireline tool assembly is submerged in liquids contained within the wellbore.

5. The wireline tool assembly of claim 4, wherein the density of the activation ring is less than the density of the tool body by from 50 $kg/m^3$ to 150 $kg/m^3$.

6. The wireline tool assembly of claim 1, wherein the stop mechanism is attached to the activation ring and moves with the activation ring relative to the tool body.

7. The wireline tool assembly of claim 6, wherein the actuator comprises a conical wall section of the tool body, the conical wall section having a first outer diameter at a point where the conical wall section connects to the cylindrical wall section and a second outer diameter disposed uphole from the first outer diameter, where the second diameter is greater than the first diameter.

8. The wireline tool assembly of claim 6, wherein when the activation ring moves axially uphole relative to the tool body, the stop mechanism contacts the conical wall section, which causes the stop mechanism to pivot radially outward into the deployed position.

9. The wireline tool assembly of claim 1, wherein the actuator is a hydraulic actuator, a mechanical linkage, or a combination of both.

10. The wireline tool assembly of claim 9, wherein the actuator comprises a hydraulic actuator, wherein, in response to axial movement of the activation ring relative to the tool body, the hydraulic actuator is configured to extend the stop mechanism radially outward from the tool body and into the deployed position.

11. The wireline tool assembly of claim 1, wherein the stop mechanism comprises a plurality of rods, wherein each of the plurality of rods has at least one pointed barb on a radially outer end of the rod, wherein the at least one pointed barb engage with the wellbore wall when the stop mechanism is in the deployed position.

12. The wireline tool assembly of claim 1, further comprising a biasing mechanism coupled to the stop mechanism and to the tool body, wherein the biasing mechanism is configured to bias the stop mechanism into the stowed position.

13. The wireline tool assembly of claim 1, wherein the biasing mechanism comprises a spring attached to the stop mechanism and to the activation ring, wherein the spring biases the stop mechanism into the stowed position.

14. The wireline tool assembly of claim 13, wherein the spring is a torsion spring.

15. The wireline tool assembly of claim 1, wherein the tool body further comprises an uphole connection, a downhole connection, or both.

16. The wireline tool assembly of claim 1, wherein the tool body further comprises a fishneck flange attached at an uphole end of the tool body.

17. The wireline tool assembly of claim 1, further comprising at least one wireline tool coupled to the tool body, wherein the at least one wireline tool comprises a data logger device, a perforation device, a sampling device, or combinations thereof.

18. The wireline tool assembly of claim 1, wherein the actuator comprises one or more angled surfaces integrated into the tool body and disposed proximate the uphole end of the tool body, where the one or more angled surfaces are configured to force the stop mechanism to pivot into the deployed position when the activation ring translates axially relative to the tool body towards the uphole end of the tool body.

19. A method for operating the wireline tool assembly of claim 1 in a wellbore extending into a subterranean formation, the method comprising:

making up the wireline tool assembly comprising the tool brake assembly and at least one wireline tool;

attaching the wireline tool assembly to a wireline or slickline;

running the wireline tool assembly downhole into the wellbore; and performing one or more operations in the wellbore with the at least one wireline tool or repositioning the wireline tool assembly in the wellbore, wherein:

running the wireline tool assembly into the wellbore, performing one or more operations in the wellbore, or repositioning the wireline tool assembly in the wellbore causes the wireline tool assembly to separate from the wireline or slickline;

when the wireline tool assembly becomes separated from the wireline or slickline, the activation ring automatically detects the freefall of the wireline tool assembly and the actuator automatically transitions the stop mechanism from the stowed position to the deployed position, which stops the wireline tool assembly at a fixed position within the wellbore.

20. The method of claim 19, further comprising, fishing the wireline tool assembly from the fixed position in the wellbore.

* * * * *